US006668815B1

(12) United States Patent
Fernandez

(10) Patent No.: US 6,668,815 B1
(45) Date of Patent: Dec. 30, 2003

(54) SELF-ALIGNING PAINTBALL GUN BARREL ASSEMBLY WITH OPTIONAL BORE SIZE ADAPTER

(75) Inventor: Paul H. Fernandez, Raleigh, NC (US)

(73) Assignee: Powerlyte, Inc., Raleigh, NC (US)

( * ) Notice: Subject to any disclaimer, the term of this patent is extended or adjusted under 35 U.S.C. 154(b) by 0 days.

(21) Appl. No.: 10/227,735

(22) Filed: Aug. 26, 2002

(51) Int. Cl.[7] ..... F41B 11/00
(52) U.S. Cl. ..... 124/83; 285/341
(58) Field of Search ..... 124/73, 74, 83, 124/85; 285/341, 355, 390

(56) References Cited

U.S. PATENT DOCUMENTS

| | | | | |
|---|---|---|---|---|
| 985,308 | A | | 2/1911 | Van Voorhis |
| 2,003,290 | A | | 6/1935 | Gurney et al. |
| 2,117,935 | A | | 5/1938 | Benjamin et al. |
| 3,336,058 | A | * | 8/1967 | Franck |
| 3,989,027 | A | | 11/1976 | Kahelin |
| 4,644,930 | A | | 2/1987 | Mainhardt |
| 4,989,902 | A | * | 2/1991 | Putch |
| 5,630,406 | A | | 5/1997 | Dumont |
| 5,687,999 | A | * | 11/1997 | Lancry et al. |
| D440,262 | S | | 4/2001 | Fernandez et al. |
| D441,410 | S | | 5/2001 | Fernandez et al. |
| 6,273,080 | B1 | | 8/2001 | Sullivan, Jr. |
| 6,295,752 | B1 | | 10/2001 | Havlock |
| 2002/0078616 | A1 | | 6/2002 | Perry et al. |

FOREIGN PATENT DOCUMENTS

| | | | |
|---|---|---|---|
| DE | 26 02 455 | | 8/1977 |
| GB | 1033880 | * | 6/1966 |

OTHER PUBLICATIONS

Article entitled "LAPCO Autococker Breech–Sizer." Ravi's Paintball Place; 1998 http://www.paintballravi.com/Articles/PCRIarticles/PCRI_LAPCO_sizer.html (3 pg).
Article entitled "Custom Products Pro–Barrel Kits." Custom Products http://www.customyoyo.com/kits.html (1 page).
Article entitled "Choke Tubes." Gunners Den; http://www.gunnersden.com/index.htm.shotgun–choke–tubes.html (3 pages).
Article entitled "PHAT Performance Barrel System." (2 pages).
Magazine Article entitled "High–Tech Barrel Theory" by Russell Maynard Action Pursuit Games; Dec., 1995; (8 pages).
Internet Page; http://www.warpig.com/paintball/technical/wc00/MVC197S.jpg (1 page).

* cited by examiner

*Primary Examiner*—John A. Ricci
(74) *Attorney, Agent, or Firm*—Coats & Bennett, P.L.L.C.

(57) ABSTRACT

A paintball gun barrel assembly includes a muzzle and a shank assembly that is self-aligning with respect to the muzzle due to the interaction of complementary angled surfaces. The shank assembly may include a bore tube that removably fits within an insert housing and has a first bore and a first concentric angled surface on an output end thereof. The muzzle has a second bore and a second concentric angled surface on the input end thereof. Mating the insert housing, with the bore tube inside, to the muzzle portion engages the first angled surface with the second angled surface causing the first bore at the output end of the first bore tube to substantially align with the second bore at the input end of the muzzle portion. A plurality of different size bore tubes may be used, each having a different internal bore diameter, but the same outer dimensions.

34 Claims, 4 Drawing Sheets

SELF-ALIGNING PAINTBALL GUN BARREL ASSEMBLY WITH OPTIONAL BORE SIZE ADAPTER

FIELD OF THE INVENTION

The present invention is directed generally to paintball guns; and, more particularly, to a self-aligning multi-part paintball gun barrel assembly.

BACKGROUND OF THE INVENTION

Pneumatic paintball guns launch fluid-filled projectiles by controlling the release of compressed gas from the gun. The fluid-filled projectiles, variously denominated as shooting capsules, marking pellets, and paintballs (hereinafter generically referred to as "paintballs") are generally made of a fragile shell filled with biodegradable "paint." When a competitor or other object is hit with a paintball, the shell ruptures and the paint is released onto and marks the target, thereby providing evidence of the hit.

As can be appreciated, it is desirable to have a pneumatic paintball gun that provides accurate and consistent aiming. However, this has proved somewhat problematic in the prior art due, at least in part, on variations in the paintballs themselves. Although the shell of a paintball ideally has a diameter of 0.68 inches, paintballs in practice have varying diameters. Real paintballs typically vary from between 0.65 to 0.70 inches, due to variations among manufacturers and other factors, such as ambient weather conditions.

Separately, it has proven desirable to have paintball gun barrels formed of two or more pieces connected in series that may be disassembled in order to make storage and transport easier. Because such arrangements typically have two parts, a shank portion that attaches to the paintball gun body and a muzzle portion that attaches to the distal end of the shank, these arrangements are commonly referred to as "two-piece" paintball gun barrels. When the two pieces of the barrel are designed to be connected via a simple threaded connection, as is typical, one problem that commonly arises is providing good alignment between the bores of the two portions. This is due to the very tight dimensional control needed to size the features appropriately and to keep the bores concentric with the threads on the mating ends of the two barrel pieces. If the two bores are not concentric where they meet, a lip may be formed in the combined barrel bore that has a tendency to rupture the skin of the paintballs while the paintballs are being fired through the barrel, leading to obviously poor performance and user dissatisfaction.

SUMMARY OF THE INVENTION

The present invention is directed to a paintball gun barrel assembly. The paintball gun barrel assembly includes a muzzle portion that removably couples to a shank assembly. The shank assembly is adapted to mate to a paintball gun body and has an internal first bore therethrough and a first angled surface on an output end thereof substantially concentric with the first bore thereat. The muzzle portion has a second bore, an output end, and an input end; the input end having a second angled surface substantially concentric with the second bore. Mating the muzzle to the shank assembly causes the respective angled surfaces to inter-engage and thereby causes the first bore at the output end of the shank assembly to substantially align with the second bore at the input end of the muzzle. Thus, the shank assembly and the muzzle are self-aligning with respect to each other.

In some embodiments, the shank assembly includes an insert housing with a first removable bore tube insert. The insert housing is adapted to mate to the paintball gun body and has a longitudinal internal passage. The bore tube is adapted to removably fit in the internal passage of the insert housing. The first angled surface and the first bore are associated with the bore tube. With the first bore tube disposed in the insert housing and the insert housing mated to the muzzle portion, engaging the first angled surface with the second angled surface causes the first bore at the output end of the first bore tube to substantially align with the second bore at the input end of the muzzle portion. Thus, in these embodiments, the bore tube portion of the shank assembly and the muzzle are self-aligning with respect to each other.

In other embodiments of the present invention, a plurality of different size bore tubes may be used, each having a different internal bore diameter but the same outer dimensions. With such an arrangement, a user may readily change the effective bore diameter of shank assembly to accommodate different sizes of paintballs. The user need only remove the muzzle by unscrewing it from the shank assembly, slide the first bore tube out from the insert housing, insert a new bore tube into the insert housing, and reattach the muzzle. Note that no special alignment process is needed, as the muzzle and bore tubes are self-aligning. Further, the entire barrel bore size change process can be accomplished without removing the insert housing from the gun body.

DETAILED DESCRIPTION OF THE INVENTION

Figure 1:
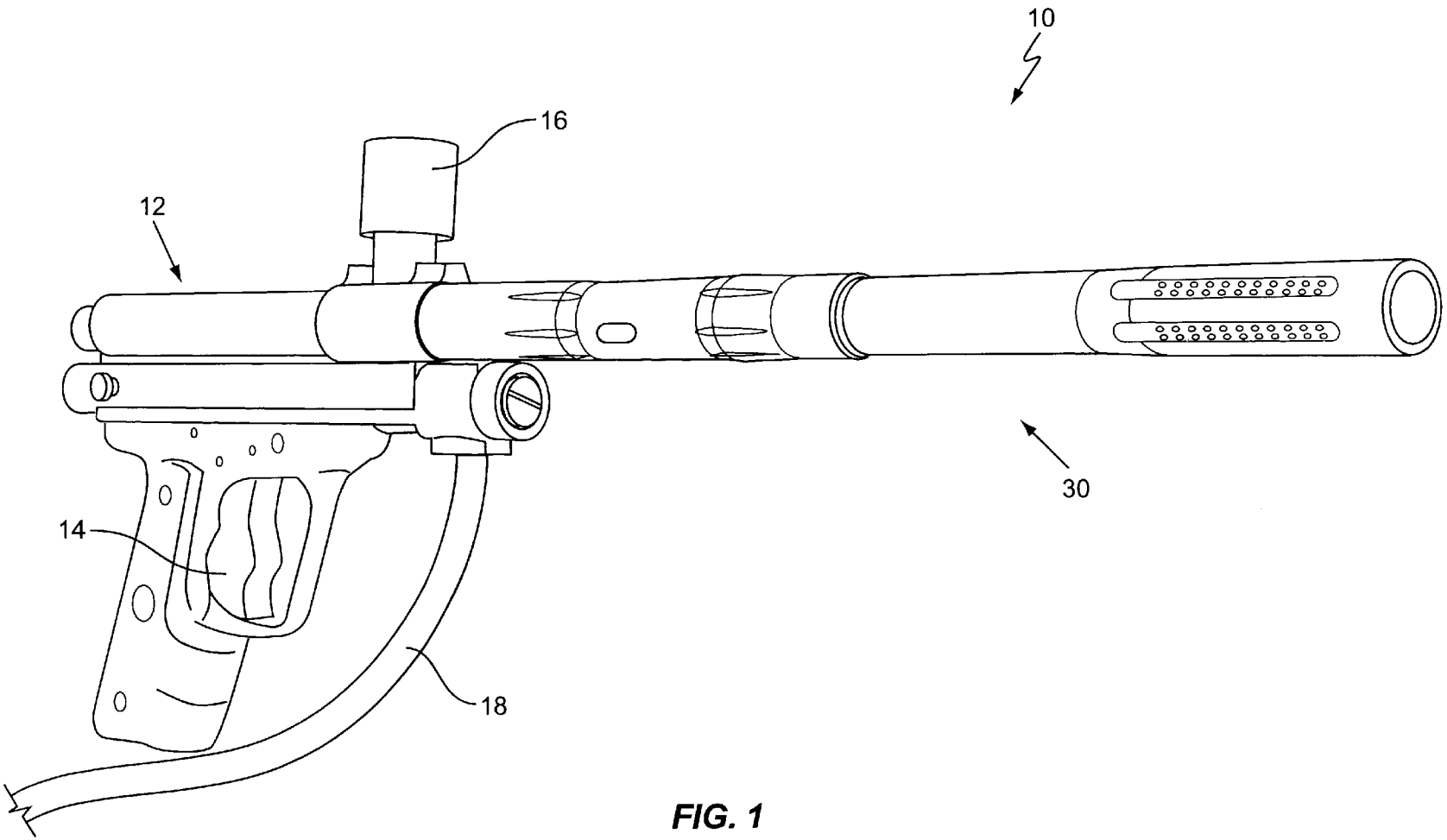
FIG. 1 shows one embodiment of the paintball gun barrel assembly of the present invention mated to a paintball gun body.

As illustrated in FIG. 1, a paintball gun, generally designated 10, is shown with a barrel assembly 30 according to the present invention. The gun 10 may take any form known in the art, and typically includes a main gun body 12 having a trigger 14, a magazine 16, and an air hose 18 connected to a supply of pressurized air. Relevant to the present discussion, the main gun body 12 typically includes an internally threaded orifice leading to its firing chamber; the gun barrel assembly 30 of the present invention is intended to mate to the gun body 12 via this threaded orifice. As the other details of the paintball gun 10 are not necessary for understanding the present invention by one of ordinary skill in the art, they are omitted for brevity. Examples of suitable paintball guns are available commercially from Worrgame Products of Corona, Calif. and WDP of Birmingham, England.

The gun barrel assembly 30 attaches to the main gun body 12. The gun barrel assembly 30 includes a muzzle portion 40 distal from the gun body 12 and a shank assembly 60 connecting the muzzle portion 40 to the gun body 12.

Figure 2:
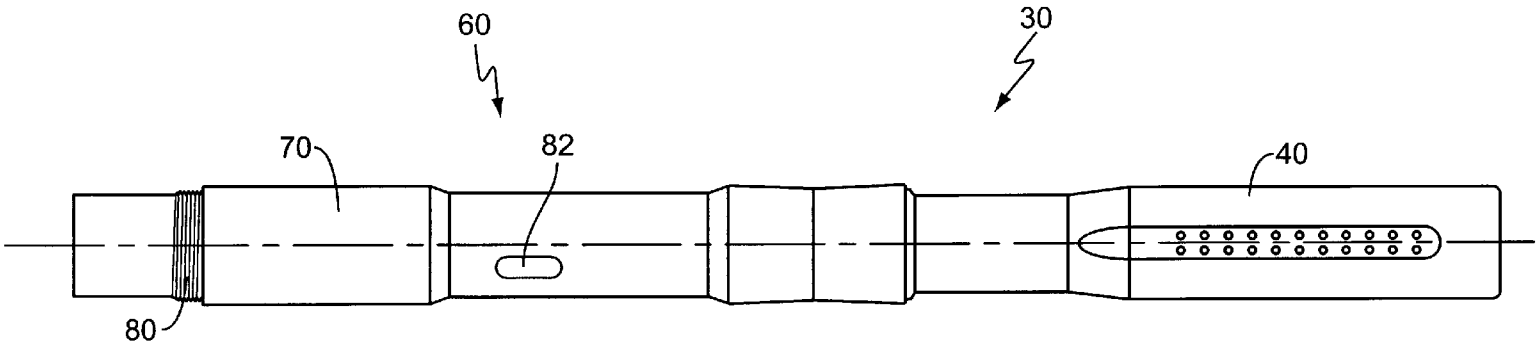
FIG. 2 shows one embodiment of the paintball gun barrel assembly of the present invention.
Figure 4:
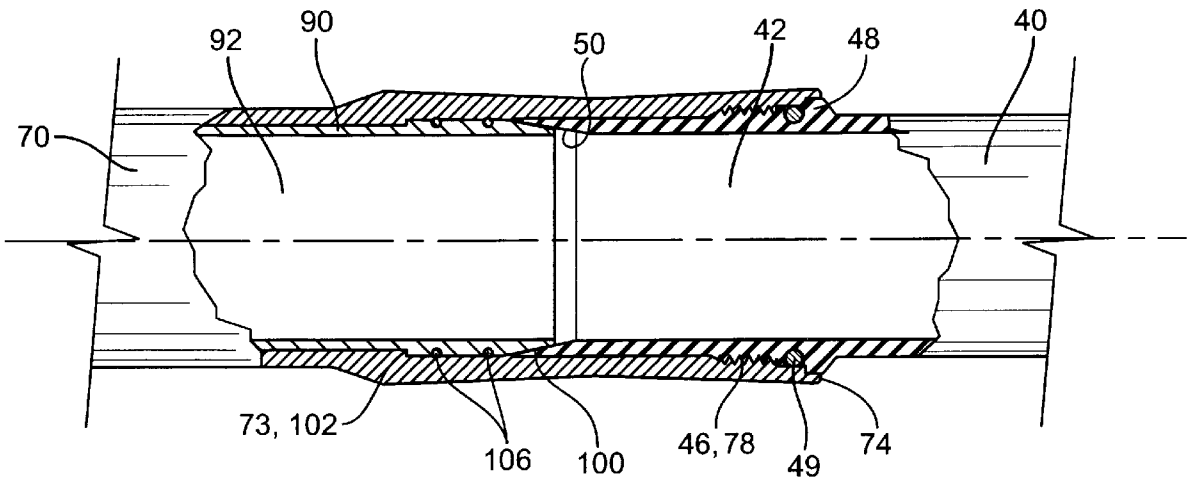
FIG. 4 is a partial cross-sectional view of the coupling between the muzzle and the shank assembly of FIG. 2.
Figure 3:
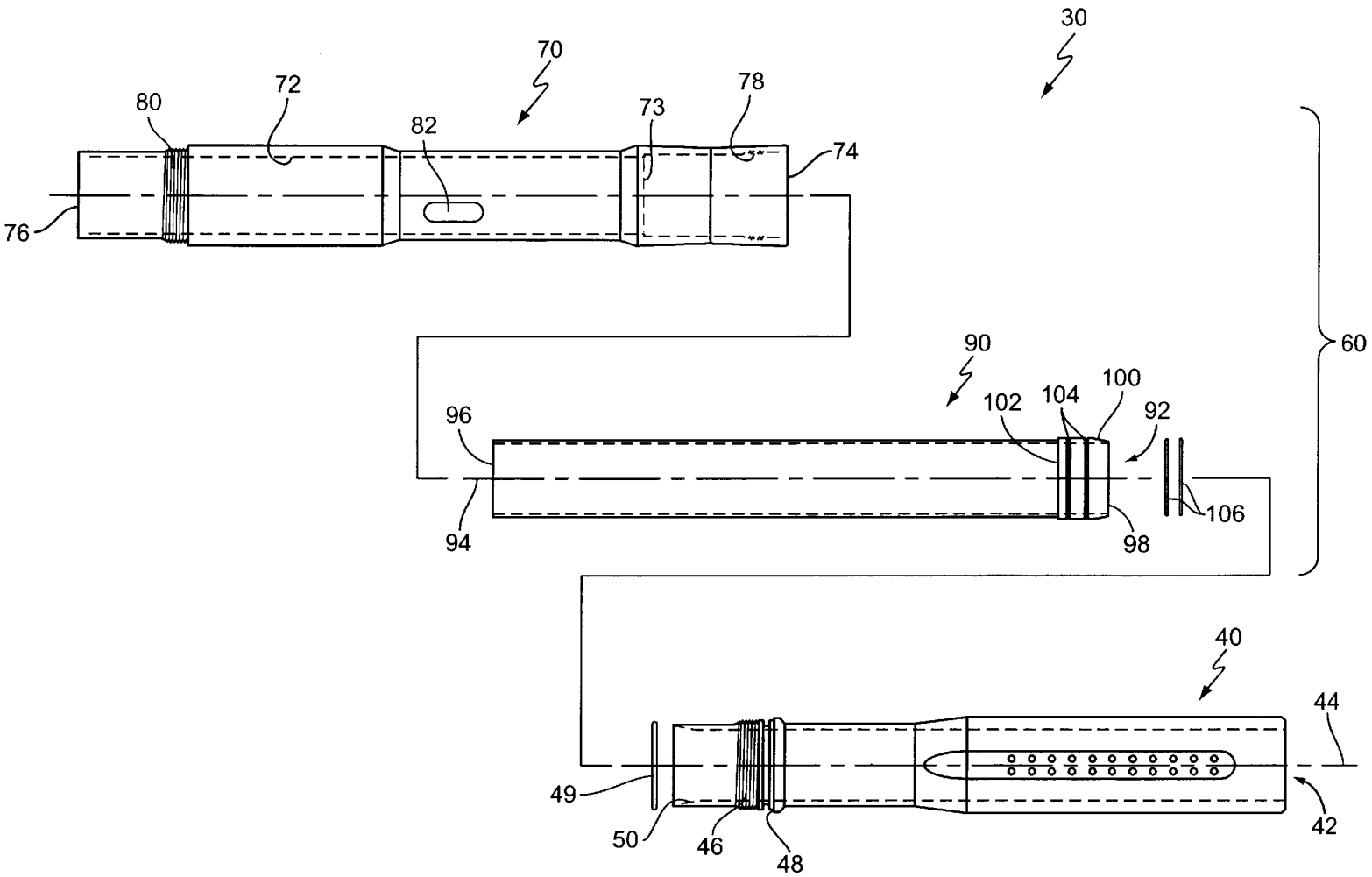
FIG. 3 shows an exploded view of the components of FIG. 2.
Figure 5:
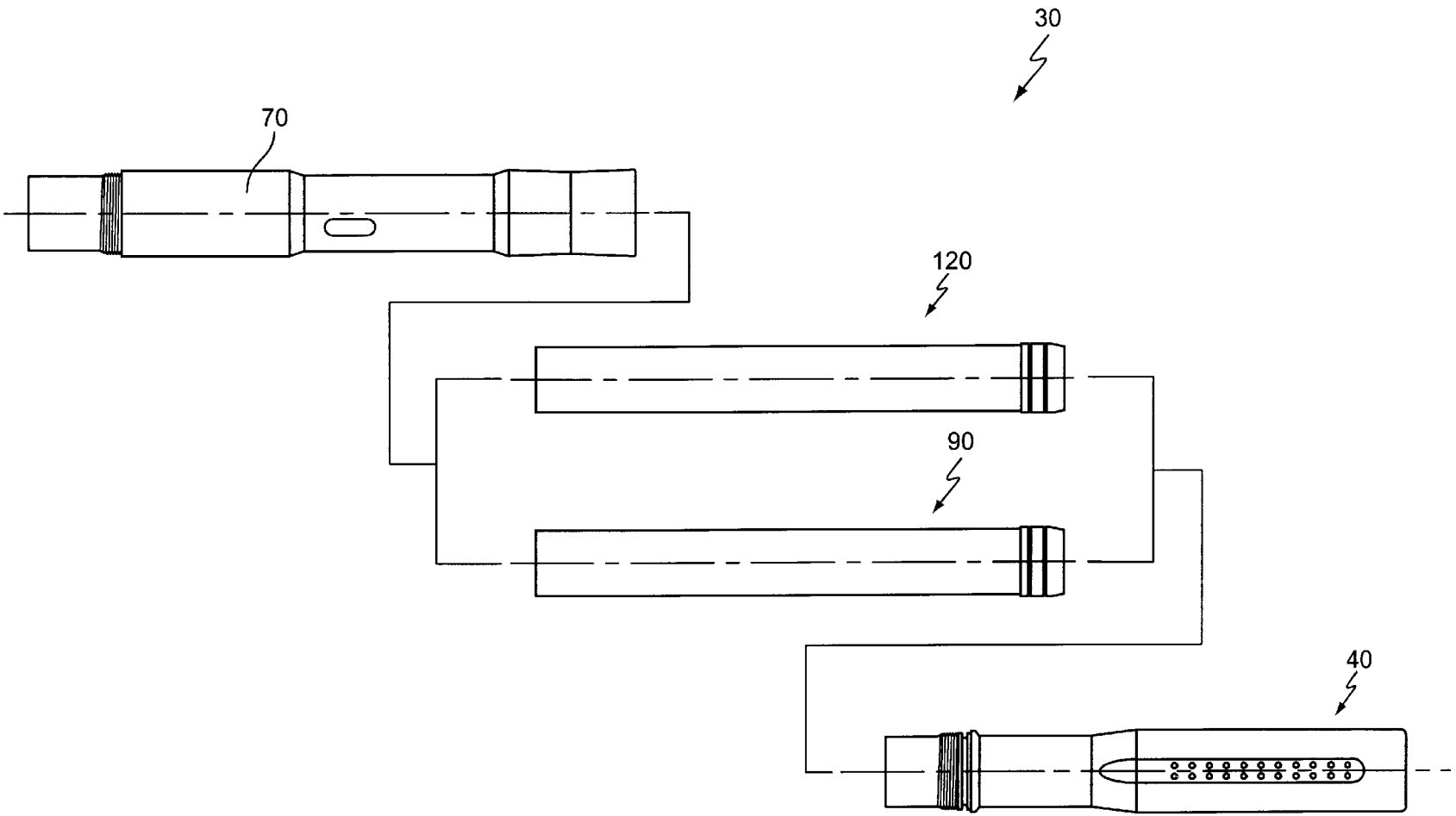
FIG. 5 shows an exploded view of another embodiment of the present invention including two different sized bore tubes.

Referring to FIGS. 2–4, the muzzle portion 40 (or simply "muzzle") is generally elongate with a bore 42 running therethrough along a longitudinal axis 44. As illustrated, the distal portion of the muzzle 40 may include a plurality of holes and/or flarings as known in the art. The proximal portion of the muzzle 40 includes external threads 46, an external shoulder 48, and an angled surface 50. The external shoulder 48, which is disposed distal to the threads 46, provides a stop for a optional seal 49, such as an elastomeric O-ring. The angled surface 50 is disposed at the input end of the bore 42 of the muzzle 40, and takes the form of a ring around the entry to the bore 42. Accordingly, the bore 42 may be described as having a chamfered entry. Of course, the angular surface 50 need not be a flat surface, but this may be advantageous; indeed a flat surface at an inward angle in the range of 5°–60°, and more particularly of approximately 10–15°, may be most advantageous. The angled surface 50 and the bore 42 should be concentric about the longitudinal axis 44. As is explained further below, the muzzle 40 releasably couples to the shank assembly 60, such as via a threaded coupling comprising threads 46.

The shank assembly 60 connects the muzzle 40 to the main gun body 12. The shank assembly 60 of FIG. 3 includes insert housing 70 and a bore tube 90. The insert housing 70 acts as the main support for the shank assembly 60, and is adapted to mate to the paintball gun main body 12. The insert housing 70 has a longitudinal internal passage 72, external threads 80 on its proximal end, internal threads 78 on its distal end, and may optionally include a viewing window 82. The internal passage 72 extends the length of the insert housing 70, from the proximal face 76 to the distal face 78. The internal passage 72 advantageously includes a shoulder 73, such as where a larger diameter inner wall extending from the distal face 78 meets a smaller diameter inner wall extending from the proximal face 76.

The bore tube 90 is a generally elongate body having a longitudinal bore 92 disposed along a longitudinal axis 94 that extends from an input end 96 to an output end 98. The output end 98 of the bore tube 90 includes an angular surface 100 that takes the form of a ring about the exit from the bore tube 90. Thus, the bore tube 90 may be said to have a chamfered exit. Once again, the angular surface 100 need not be a flat surface, but a flat surface at an outward angle of approximately 10–15° may be most advantageous. Further, it should be noted that the angular surface 50 of the muzzle 40 and the angular surface 100 of the bore tube 90 should be complimentary, so that the two angular surfaces 50,100 may engage one another. The angular surface 100 and the bore 92 of the bore tube 90 should be concentric about the longitudinal axis thereof 94. The external portion of the bore tube 90 may advantageously include an outwardly extending shoulder section 102 located slightly toward the input end 96 from the angular surface 100. It is intended that this shoulder section 102 be spaced from the input end 96 of the bore tube 90 such that when the shoulder section 102 of the bore tube 90 engages the corresponding shoulder 73 on the insert housing 70, the input end 96 of the bore tube 90 is flush with the proximal face 76 of the insert housing 70.

Advantageously, the bore tube 90 removably fits within the internal passage 72 of the insert housing 70, with the insertion of the bore tube 90 being from the direction of the distal face 74 towards the proximal face 76. As such, the outer dimensions of the bore tube 90 should be sized accordingly. However, the outer dimensions of the bore tube 90 should advantageously be sized as large as possible while still maintaining a sliding fit within the insert housing 70, so that the internal walls of the insert housing 70 provide radial support for the bore tube 90. In addition, the outer surface of the bore tube 90 may include one or more grooves 104 for accepting corresponding optional collars 106, such as common O-rings, to provide a small amount of friction to help slightly retain the bore tube 90 within the insert housing 70 during assembly and disassembly, while still allowing the output end 98 of the bore tube 90 to radially float somewhat within the insert housing 70. There may be one seal 106, preferably located towards the end nearest the muzzle portion 40, or there may be a plurality of seals 106 disposed in spaced relation to one another, if desired.

The barrel assembly 30 of FIGS. 3–4 allows for self-alignment of the bore tube 90 with the muzzle 40, thereby allowing for lower cost production of "two-piece" barrels. The user slides the bore tube 90 into the insert housing 70 from the distal face 74 of the insert housing 70, with the input end 96 inserted first. When inserted fully, the angled surface 100 of the bore tube 90 disposed towards the distal face 74 of the insert housing 70. The muzzle 40 is then attached to the insert housing 70, and screwed into place. The displacement of the muzzle 40 towards the insert housing 70 during the screwing process causes the angled surface 50 of the muzzle 40 to engage the angled surface 100 of the bore tube 90. As the muzzle 40 becomes fully threaded in place, the shoulder section 102 on the bore tube 90 engages the corresponding shoulder 73 in the internal passage 72 of the insert housing 70. As such, the distal portion of the bore tube 90 is trapped between the shoulder 73 of the insert housing 70 on one side and the angled surface 50 of the muzzle 40 on the other, resulting in firm engagement of the respective angled surfaces 50,100. Because the bore tube 90 is allowed to float very slightly within the insert housing 70, the engagement of the angled surfaces 50,100 causes the longitudinal axis 44 of the muzzle 40 and the longitudinal axis 72 of the bore tube 90 to become aligned, thereby self-aligning the bores 42,92 of the muzzle 40 and the bore tube 90.

The gun barrel assembly 30 of the present invention may include one or more additional bore tubes 120. The various bore tubes 90,120 should have the same outer dimensions, but may advantageously have bores of different inner diameters. With such an arrangement, a user may readily change the effective bore size of shank assembly 60 to accommodate different sizes of paintballs. The user need only remove the muzzle 40 by unscrewing it from the shank assembly 60, slide the first bore tube 90 out from the insert housing 70, insert a new bore tube 120 into the insert housing 70, and reattach the muzzle 40. Note that no special alignment process is needed, as the muzzle 40 and bore tubes 90,120 are self-aligning. Further, notice that the entire process can be accomplished without removing the insert housing 70 from the gun body 12.

To aid in distinguishing the various sizes of bore tubes 90,120, and identifying the one currently in use, the different (bore) sizes of bore tubes 90,120 may be color coded, with the color visible through the viewing window 82 on the insert housing 70. For instance, bore tubes 90 with an inner diameter of 0.660 inches may be colored red, bore tubes 120 of inner diameter 0.663 inches may be orange, bore tubes 120 with an inner diameter of 0.700 inches may be blue, and so forth. Of course, the various bore diameters of the bore tubes 90,120 should not be larger than the diameter of the bore 42 of the muzzle 40, so that the paintball does not encounter an inwardly extending lip and rupture inside the barrel assembly 30.

The gun barrel assembly 30 of the present invention may be sold as separate components, such as a shank assembly 60 alone for a user that already owns a muzzle 40, or as a collection or kit of an insert housing 70, a muzzle 40, a plurality of different size bore tubes 90,120, and an optional carrying case (not shown).

One embodiment of the paintball gun barrel assembly 30 of the present invention include a muzzle portion made from 6061-T6 aluminum, with an insert housing 70 made from 303 stainless steel with a 0.748 inch diameter internal passage 72 (upstream from shoulder 73) and a shoulder 73 of 0.805 inches, and a bore tube 90 made from 6061-T6 aluminum and approximately six inches long, with an outer diameter upstream from the shoulder 102 of 0.7465 inches and a shoulder 102 of 0.803 inches. The angled surfaces 50,100 may be approximately 11.5° by 3/16 inch chamfer. The overall length of the barrel assembly may be generally about twelve to sixteen inches.

The discussion above has assumed that the shank assembly 60 and muzzle 40 of the barrel assembly 30 mate via a threaded coupling (e.g., threads 46,78). However, a threaded coupling, while advantageous, is not required. Indeed, any form of coupling between the two parts 30,60 known in the art may be used, including a bayonet-type coupling, etc.

In addition, the discussion above has assumed that the shank assembly 60 comprises at least two parts—an insert housing 70 and a distinct bore tube 90. However, the self-aligning aspects of the present invention may also be realized with an alternate gun barrel assembly embodiment using a single-piece shank assembly 60 that does not include a bore tube 90 removable from an insert housing 70 but with the two parts 70,90 instead integrally formed into a single part. Such a shank assembly 60 would still have a bore 92 and a angled surface 100 on the distal end thereof. The mating of the shank assembly 60 to a muzzle portion 40 would cause the respective angled surfaces 50,100 to engage and thereby align the bore 92 of the shank assembly 60 at the output end thereof with the bore 42 of the muzzle 40 at the input end thereof. Of course, it should be realized that changing bore sizes of the shank assembly 60 in such an arrangement may require replacement of the existing shank assembly with a new shank assembly with a different size of bore 92.

The present invention may, of course, be carried out in other specific ways than those herein set forth without departing from the essential characteristics of the invention. The present embodiments are, therefore, to be considered in all respects as illustrative and not restrictive, and all changes coming within the meaning and equivalency range of the appended claims are intended to be embraced therein.

What is claimed is:

1. A paintball gun barrel assembly, comprising:

an insert housing adapted to mate to a paintball gun body and having a longitudinal internal passage;

a first bore tube having a first bore therethrough and adapted to removably fit in said internal passage; said first bore tube having a first angled surface on an output end thereof substantially concentric with said first bore;

a muzzle portion releasably coupled to said insert housing and having a second bore, an output end, and an input end; said input end having a second angled surface substantially concentric with said second bore;

wherein, with said first bore tube disposed in said insert housing and said insert housing mated to said muzzle portion, engaging said first angled surface by said second angled surface causes said first bore at said output end of said first bore tube to substantially align with said second bore at said input end of said muzzle portion.

2. The assembly of claim 1 further comprising a threaded coupling mating said muzzle portion to said insert housing.

3. The assembly of claim 2 wherein said threaded coupling comprises internal threads associated with said insert housing and external threads associated with said muzzle portion.

4. The assembly of claim 1 wherein said first bore tube comprises a first bore of a first size; and further comprising a second bore tube adapted to removably fit in said internal passage and having a third bore of a second size different from said first size.

5. The assembly of claim 4 wherein said first and second bores are substantially circular in cross-section.

6. The assembly of claim 1 wherein said first and second angled surfaces comprise complementary chamfers on said first bore tube and said muzzle portion respectively.

7. The assembly of claim 6 wherein said chamfers comprise chamfers with a chamfer angle in the range of 10° to 15°.

8. The assembly of claim 1 wherein said first bore tube has a length of at least five inches.

9. The assembly of claim 1 wherein said first bore tube has an endface opposite said first angled surface, and wherein said endface of said first bore tube is substantially flush with an end of said insert housing opposite said muzzle portion when said muzzle portion is fully coupled to said insert housing.

10. The assembly of claim 1 further comprising at least one resilient friction element disposed between said first bore tube and said insert housing and resisting relative movement therebetween.

11. The assembly of claim 10 wherein said first bore tube further comprises at least one external annular groove corresponding to a respective friction element.

12. The assembly of claim 1 wherein said longitudinal internal passage of said insert housing includes a first shoulder, wherein said first bore tube includes a second shoulder spaced from said first angled surface, and wherein engagement of said first and second shoulders prevents further displacement of said first bore tube away from said output end of said insert housing.

13. The assembly of claim 1 wherein said first bore of said first bore tube is disposed along a first longitudinal axis, wherein said second bore of said muzzle portion is disposed along a second axis, and wherein engaging said first angled surface by said second angled surface causes said first axis to substantially align with said second axis.

14. The assembly of claim 1:

further comprising a threaded coupling mating said muzzle portion to said insert housing;

wherein said first and second angled surfaces comprise complementary chamfers on said first bore tube and said muzzle portion respectively;

wherein said first bore tube has a length of at least five inches;

wherein said first bore tube has an endface opposite said first angled surface; and wherein said endface of said first bore tube is substantially flush with an end of said insert housing opposite said muzzle portion when said muzzle portion is fully coupled to said insert housing.

15. The assembly of claim 14 wherein said first bore tube comprises a first bore of a first size; and further comprising a second bore tube adapted to removably fit in said internal passage and having a third bore of a second size different from said first size.

16. A paintball gun barrel assembly, comprising:

a shank assembly adapted to mate to a paintball gun body, said shank assembly having a first bore and a first angled surface on an output end thereof substantially concentric with said first bore;

a muzzle portion disposed downstream of, and releasably coupled to, said shank assembly; said muzzle portion having a second bore, an output end, and an input end; said input end having a second angled surface substantially concentric with said second bore;

wherein, with said muzzle portion mated to said shank assembly, engaging said first angled surface by said second angled surface causes said first bore at said output end of said shank assembly to substantially align with said second bore at said input end of said muzzle portion.

17. The assembly of claim 16 wherein said shank assembly comprises an insert housing and a first bore tube adapted to removably fit in said insert housing.

18. The assembly of claim 17 wherein said first bore tube comprises a first bore of a first size; and further comprising a second bore tube adapted to removably fit in said insert housing and having a third bore of a second size different from said first size.

19. The assembly of claim 16 wherein said first and second angled surfaces comprise complementary chamfers on said shank assembly and said muzzle portion respectively.

20. The assembly of claim 16 wherein said first bore of said shank assembly is disposed along a first longitudinal axis, wherein said second bore of said muzzle portion is disposed along a second axis, and wherein engaging said first angled surface by said second angled surface causes said first axis to substantially align with said second axis.

21. A method of configuring a paintball gun, comprising:

providing a shank assembly having a first bore therethrough and adapted to mate to a paintball gun body; said first shank assembly having a first angled surface on an output end thereof substantially concentric with said first bore;

providing a muzzle portion having a second bore, an output end, and an input end; said input end having a second angled surface substantially concentric with said second bore; and releasably coupling said muzzle portion to said shank assembly to engage said first angled surface with said second angled surface and thereby cause said first bore at said output end of said shank assembly to substantially align with said second bore at said input end of said muzzle portion.

22. The method of claim 21 wherein said shank assembly further comprises first threads and said muzzle portion comprises second threads, and wherein said coupling said muzzle portion to said shank assembly comprises interengaging said first and second threads.

23. The method of claim 21 wherein said first bore of said shank assembly is disposed along a first longitudinal axis, wherein said second bore of said muzzle portion is disposed along a second axis, and wherein engaging said first angled surface with said second angled surface causes said first axis to substantially align with said second axis.

24. The method of claim 21 further comprising mating said shank assembly to a paintball gun body.

25. The method of claim 21 wherein said shank assembly comprises an insert housing and a first bore tube adapted to removably fit in said insert housing, said first bore and said first angled surface associated with said first bore tube; further comprising inserting said first bore tube in said insert housing; and wherein said coupling said muzzle portion to said insert housing comprises coupling said muzzle portion to said insert housing while said first bore tube is disposed within said insert housing.

26. The method of claim 25 further comprising mating said shank assembly to a paintball gun body by mating a first end of said insert housing to the paintball gun body and wherein inserting said first bore tube into said insert housing comprises inserting said first bore tube into a second end of said insert housing.

27. The method of claim 26 wherein coupling said muzzle portion to said shank assembly comprises coupling said muzzle portion to said second end of said insert housing.

28. The method of claim 26 wherein inserting said second bore tube into said insert housing comprises inserting said second bore tube into said insert housing without removing said insert housing from the paintball gun body.

29. The method of claim 25 wherein said first bore tube comprises a first bore of a first size; and further comprising:

uncoupling said muzzle portion from said insert housing and thereafter removing said first bore tube from said insert housing;

thereafter, inserting a second bore tube into said insert housing, said second bore tube having a third bore of a second size different from said first size, said second bore tube further having a third angled surface on an output end thereof substantially concentric with said third bore;

coupling said muzzle portion to said insert housing to mate said third angled surface with said second angled surface and thereby cause said third bore at said output end of said second bore tube to substantially align with said second bore at said input end of said muzzle portion.

30. The method of claim 29 wherein removing said first bore from said insert housing comprises decoupling said muzzle portion from said insert housing.

31. The method of claim 29 wherein removing said first bore from said insert housing comprises sliding said first bore from said insert housing from an end of said insert housing distal from said paintball gun body after said uncoupling said muzzle portion from said insert housing.

32. The method of claim 25 further comprising mating a first end of said insert housing to a paintball gun body, and wherein inserting said first bore tube into said insert housing comprises inserting said first bore tube into a second end of said insert housing.

33. The method of claim 25 wherein said first bore tube comprises a first bore of a first size; wherein inserting said first bore tube into said insert housing comprises inserting said first bore tube into a second end of said insert housing; and further comprising:

mating a first end of said insert housing to a paintball gun body;

uncoupling said muzzle portion from said insert housing and thereafter removing said first bore tube from said insert housing;

thereafter, inserting a second bore tube into said insert housing, said second bore tube having a third bore of a second size different from said first size, said second bore tube further having a third angled surface on an output end thereof substantially concentric with said third bore;

coupling said muzzle portion to said insert housing to mate said third angled surface with said second angled surface and thereby cause said third bore at said output end of said second bore tube to substantially align with said second bore at said input end of said muzzle portion.

34. The method of claim 33 wherein:

removing said first bore from said insert housing comprises decoupling said muzzle portion from said insert housing and sliding said first bore from said insert housing from an end of said insert housing distal from said paintball gun body after said decoupling said muzzle portion from said insert housing;

inserting said second bore tube into said insert housing comprises inserting said second bore tube into said insert housing without removing said insert housing from the paintball gun body.

* * * * *